US011641966B2

(12) United States Patent
Nakanishi

(10) Patent No.: US 11,641,966 B2
(45) Date of Patent: May 9, 2023

(54) PACKAGE RECEIVING DEVICE AND PACKAGE RECEIVING METHOD

(71) Applicant: PROPERTY AGENT Inc., Tokyo (JP)

(72) Inventor: Sei Nakanishi, Tokyo (JP)

(73) Assignee: PROPERTY AGENT, INC., Tokyo (JP)

( * ) Notice: Subject to any disclaimer, the term of this patent is extended or adjusted under 35 U.S.C. 154(b) by 425 days.

(21) Appl. No.: 16/831,907

(22) Filed: Mar. 27, 2020

(65) Prior Publication Data

US 2021/0228009 A1 Jul. 29, 2021

(30) Foreign Application Priority Data

Jan. 28, 2020 (JP) ..... JP2020-011587

(51) Int. Cl.
*A47G 29/124* (2006.01)
*A47G 29/126* (2006.01)
(Continued)

(52) U.S. Cl.
CPC ..... *A47G 29/124* (2013.01); *A47G 29/126* (2013.01); *E05B 47/00* (2013.01); *E05B 65/52* (2013.01); *E05B 2047/0056* (2013.01)

(58) Field of Classification Search
CPC .... A47G 29/124; A47G 29/14; A47G 29/141; A47G 2029/143; A47G 2029/145;
(Continued)

(56) References Cited

U.S. PATENT DOCUMENTS 9,764,836 B1 * 9/2017 Elzinga ..... B64C 39/024
9,783,075 B2 * 10/2017 Henry ..... B64F 1/12
(Continued)

FOREIGN PATENT DOCUMENTS

JP 2018-045643 A 3/2018
JP 6201092 A 9/2018
(Continued)

OTHER PUBLICATIONS

Office Action of corresponding Japanese application No. 2020-183714 dated Feb. 10, 2021.
(Continued)

*Primary Examiner* — Mark A Williams
(74) *Attorney, Agent, or Firm* — Renner, Kenner; Edward G. Greive

(57) ABSTRACT

A package receiving device 10 includes: a casing 12 having an opening 12*a* formed in an upper surface thereof; a placement table 22 configured to move up and down between a raised position at which the placement table 22 is located at the upper surface opening 12*a* of the casing 12 and a lowered position at which the placement table 22 is located inside the casing 12; a lid member 32 configured to move between an opening position and a closing position so that the lid member 32 opens/closes the upper surface opening 12*a* of the casing 12. After the package is placed thereon, the placement table 22 is moved to the lowered position from the raised position, and subsequently the lid member 32 is moved to the closing position from the opening position, whereby the package placed on the placement table 22 is housed inside the casing 12.

13 Claims, 11 Drawing Sheets

(51) Int. Cl.
*E05B 65/52* (2006.01)
*E05B 47/00* (2006.01)

(58) Field of Classification Search
CPC ..... A47G 29/126; E05B 47/00; E05B 65/52; E05B 2047/0056
See application file for complete search history.

(56) References Cited

U.S. PATENT DOCUMENTS

| | | | | |
|---|---|---|---|---|
| 9,975,651 | B1 * | 5/2018 | Eck | B64C 39/024 |
| 10,028,606 | B1 * | 7/2018 | Ritchie | G07C 9/00912 |
| 10,173,774 | B2 * | 1/2019 | Jones | B64C 39/024 |
| 10,874,240 | B2 * | 12/2020 | Lewis | A47G 29/20 |
| 11,379,784 | B1 * | 7/2022 | Eastman | G06Q 10/083 |
| 2015/0158599 | A1 * | 6/2015 | Sisko | B64F 1/20 244/114 R |
| 2015/0175276 | A1 * | 6/2015 | Koster | B64F 1/32 244/114 R |
| 2015/0183528 | A1 * | 7/2015 | Walsh | A47G 29/14 244/114 R |
| 2016/0257423 | A1 * | 9/2016 | Martin | B64C 39/024 |
| 2017/0032686 | A1 * | 2/2017 | Alonso Tabares | G08G 5/0091 |
| 2017/0147975 | A1 * | 5/2017 | Natarajan | G07C 9/00182 |
| 2017/0203857 | A1 * | 7/2017 | O'Toole | G06Q 10/083 |
| 2017/0320572 | A1 * | 11/2017 | High | B64D 1/02 |
| 2018/0049575 | A1 * | 2/2018 | Yamrick | G06Q 10/0836 |
| 2018/0105289 | A1 * | 4/2018 | Walsh | A47G 29/141 |
| 2018/0203465 | A1 * | 7/2018 | Suzuki | B64F 1/00 |
| 2018/0290764 | A1 * | 10/2018 | McMillian | G08G 5/045 |
| 2018/0352988 | A1 * | 12/2018 | Ortiz | A47G 29/20 |
| 2019/0039751 | A1 * | 2/2019 | Janssen | B64C 39/024 |
| 2020/0281386 | A1 * | 9/2020 | Knox | A47G 29/22 |
| 2020/0288895 | A1 * | 9/2020 | Bennet | B64C 39/024 |
| 2020/0359819 | A1 * | 11/2020 | Roberts | A47G 29/141 |
| 2020/0407079 | A1 * | 12/2020 | Kim | B64F 1/32 |
| 2022/0192406 | A1 * | 6/2022 | Haley | A47G 29/20 |

FOREIGN PATENT DOCUMENTS

| | | | |
|---|---|---|---|
| JP | 2018-193061 | A | 12/2018 |
| JP | 65479084 | A | 6/2019 |
| JP | 2019-519261 | A | 7/2019 |
| JP | 2020180491 | A | 11/2020 |

OTHER PUBLICATIONS

Japanese Patent Application No. 2020-011587 Office Action dated May 18, 2020.

* cited by examiner

PACKAGE RECEIVING DEVICE AND PACKAGE RECEIVING METHOD

CROSS-REFERENCE TO RELATED APPLICATION

This application claims priority to Japanese Patent Application No. 2020-011587 filed on Jan. 28, 2020, the entire contents of which are incorporated herein by reference.

BACKGROUND OF THE INVENTION

1. Field of the Invention

The present invention relates to a package receiving device and a package receiving method.

2. Description of the Related Art

In recent years, a technique of delivering a delivery article to a receiving container of a user by an unmanned airplane such as a drone has been known (see, for example, Japanese Patent No. 6201092 (JP6201092B)). The receiving container disclosed in Japanese Patent No. 6201092 has an automatic opening/closing delivery article receiving door, an automatic slide-type receiving table, a delivery-article-taking-out door, and a communication device for communicating information or the like that is a key for unlocking a lock mechanism upon receipt.

SUMMARY OF THE INVENTION

The receiving container disclosed in Japanese Patent No. 6201092 needs to be installed on a part of a building such as a window, a veranda terrace, or a wall of the building, and there are restrictions on the installation location. In addition, the receiving container disclosed in Japanese Patent No. 6201092 does not have a shape suitable for receiving a delivery article delivered in a suspended state by an unmanned airplane such as a drone.

The present invention has been made in consideration of such circumstances, and an object of the present invention is to provide a package receiving device and a package receiving method that allow a package delivered by a flight vehicle to be received and housed inside a casing.

A package receiving device according to the present invention includes: a casing having an opening formed in an upper surface thereof; a placement table configured to move up and down between a raised position at which the placement table is located at the upper surface opening of the casing and a lowered position at which the placement table is located inside the casing; a first drive unit configured to move the placement table between the raised position and the lowered position; a lid member configured to move between an opening position at which the lid member opens the upper surface opening of the casing and a closing position at which the lid member closes the upper surface opening of the casing; a second drive unit configured to move the lid member between the opening position and the closing position; and a control unit configured to control the first drive unit and the second drive unit such that a package placed on the placement table is housed inside the casing, by moving the placement table from the raised position to the lowered position from an initial state where the placement table is located at the raised position and the lid member is located at the opening position, and subsequently moving the lid member from the opening position to the closing position.

A package receiving method according to the present invention is a package receiving method by a package receiving device including a casing having an opening formed in an upper surface thereof, a placement table configured to move up and down between a raised position at which the placement table is located at the upper surface opening of the casing and a lowered position at which the placement table is located inside the casing, and a lid member configured to move between an opening position at which the lid member opens the upper surface opening of the casing and a closing position at which the lid member closes the upper surface opening of the casing, the package receiving method including the steps of: moving the placement table from the raised position to the lowered position from an initial state where the placement table is located at the raised position and the lid member is located at the opening position; and moving the lid member from the opening position to the closing position after moving the placement table from the raised position to the lowered position.

DESCRIPTION OF EMBODIMENT

Figure 1:
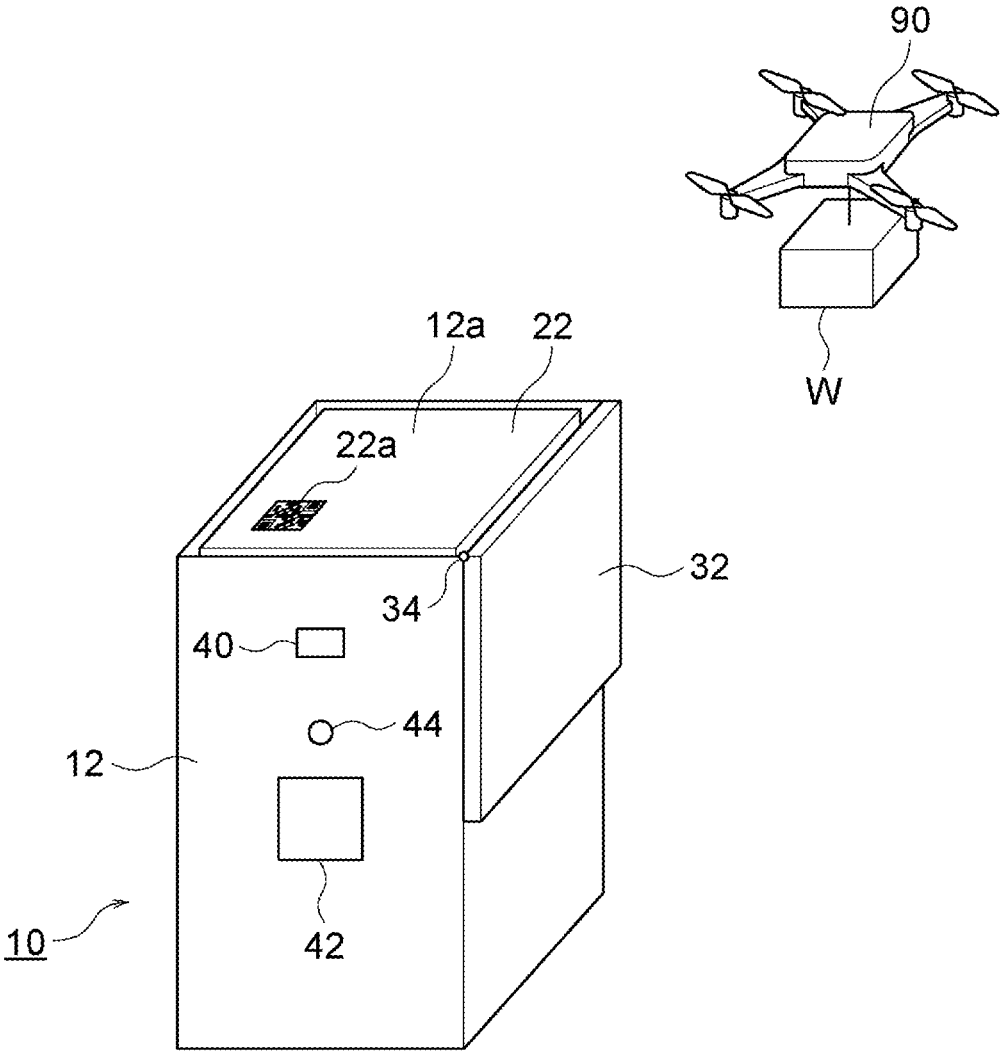
FIG. 1 is a perspective view schematically illustrating the appearance of a package receiving device according to an embodiment of the present invention.

Hereinafter, an embodiment of the present invention will be described with reference to the drawings. FIG. 1 to FIG.

Figure 2:
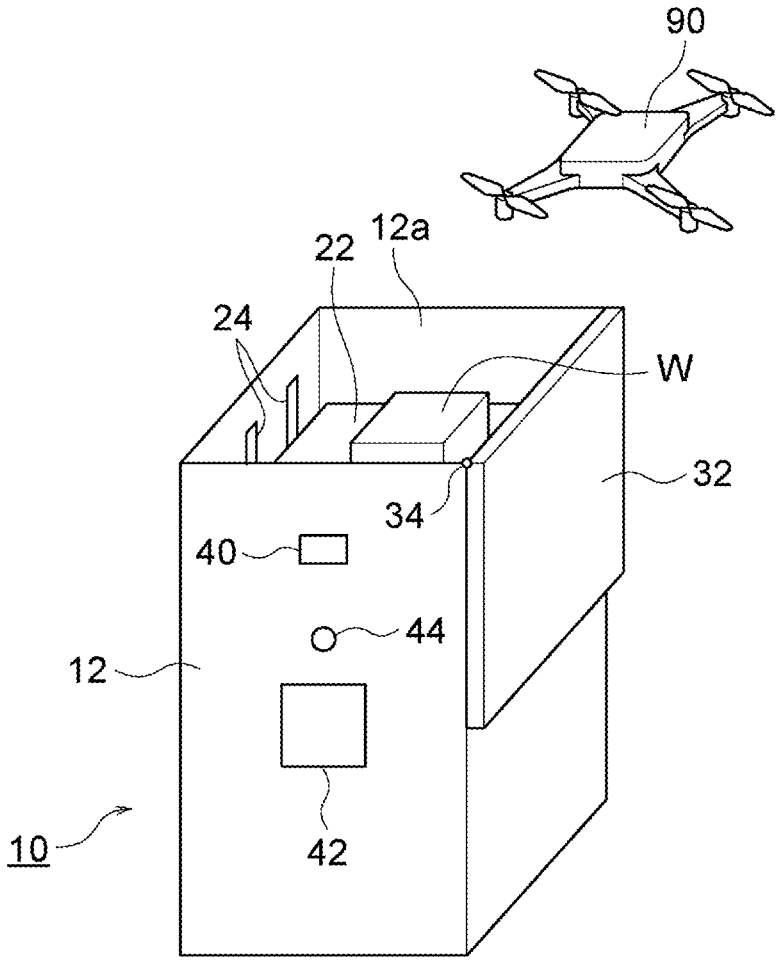
FIG. 2 is a perspective view illustrating a state when a placement table of the package receiving device shown in FIG. 1 is lowered after a package is placed on the placement table.
Figure 3:
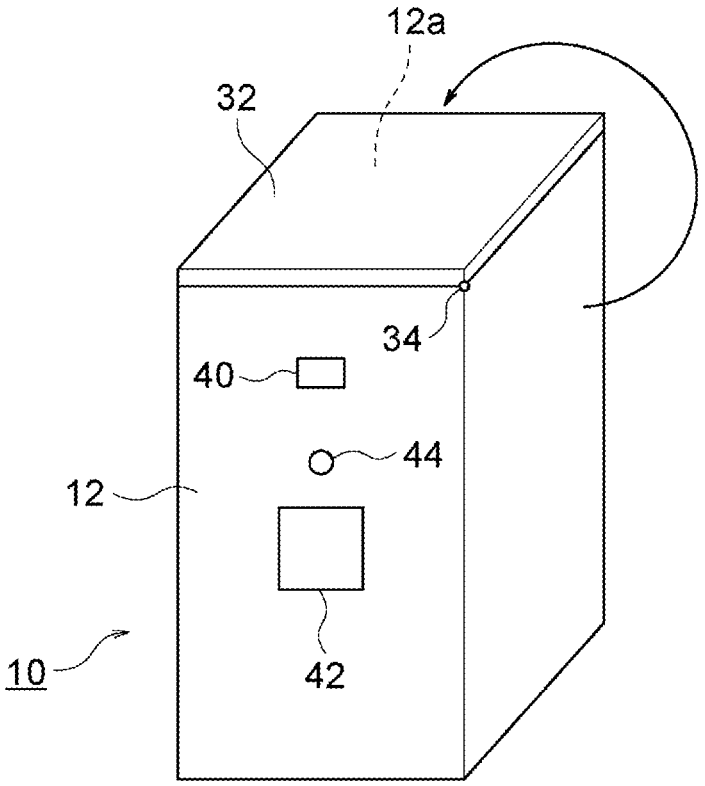
FIG. 3 is a perspective view illustrating a state when an upper opening is closed by a lid member in the package receiving device shown in FIG. 2.
Figure 4:
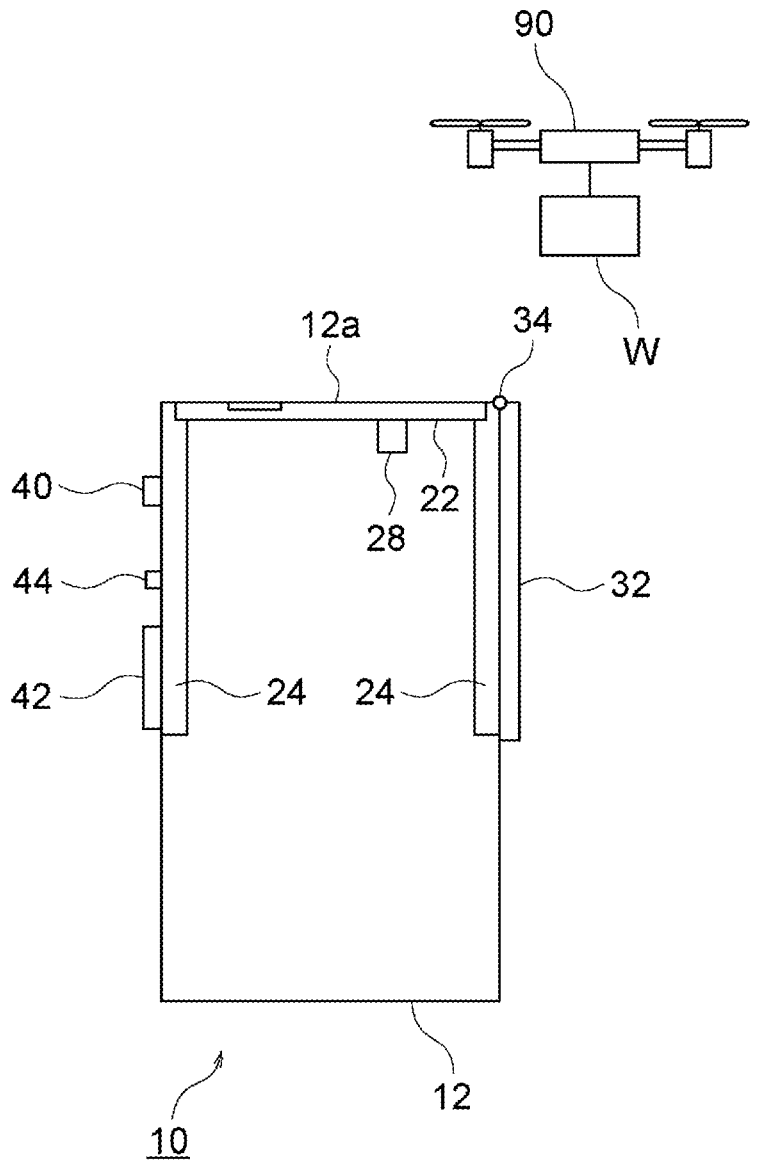
FIG. 4 is a configuration diagram illustrating the internal configuration of the package receiving device shown in FIG. 1, etc.
Figure 5:
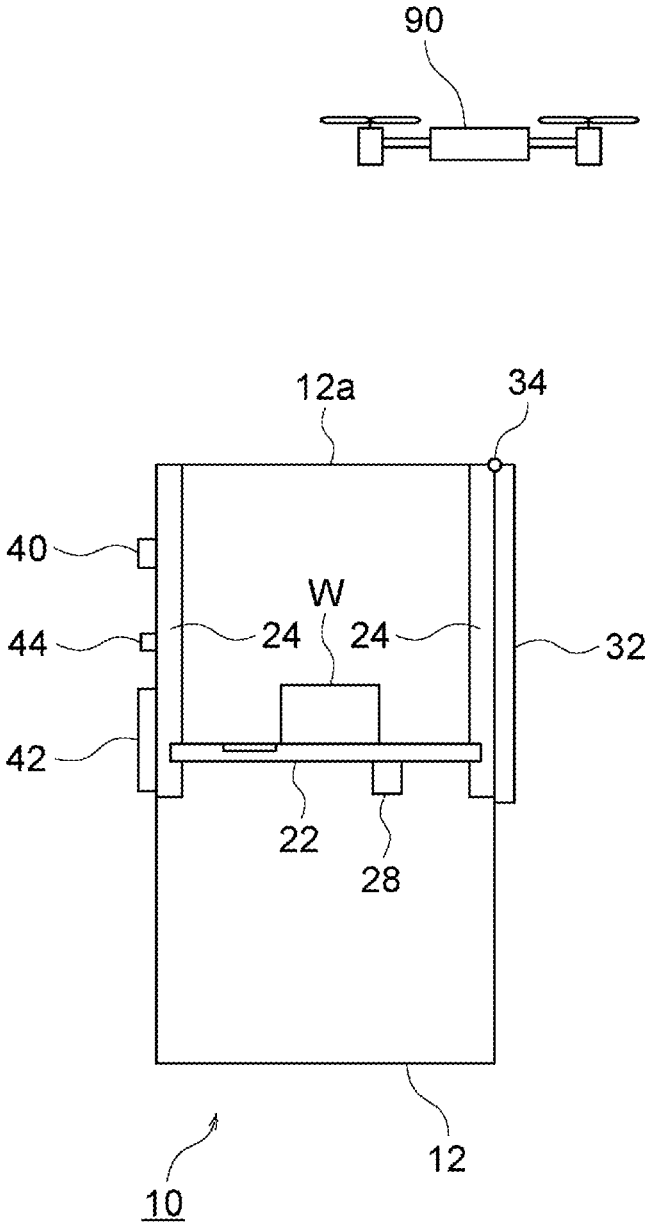
FIG. 5 is a configuration diagram illustrating the internal configuration when the placement table of the package receiving device shown in FIG. 4 is lowered after a package is placed on the placement table.
Figure 6:
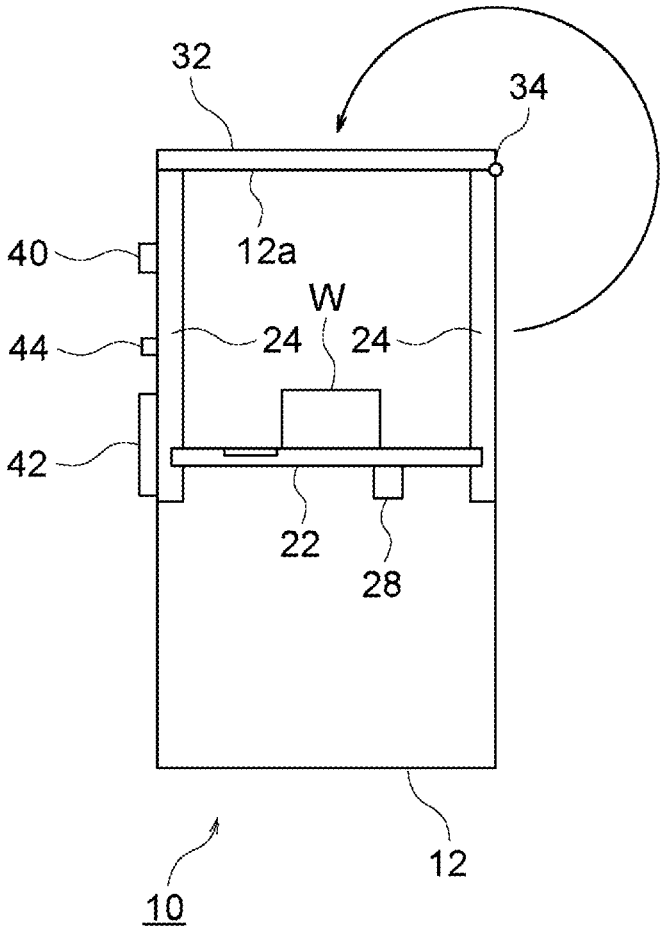
FIG. 6 is a configuration diagram illustrating the internal configuration when the upper opening is closed by the lid member in the package receiving device shown in FIG. 5.
Figure 7:
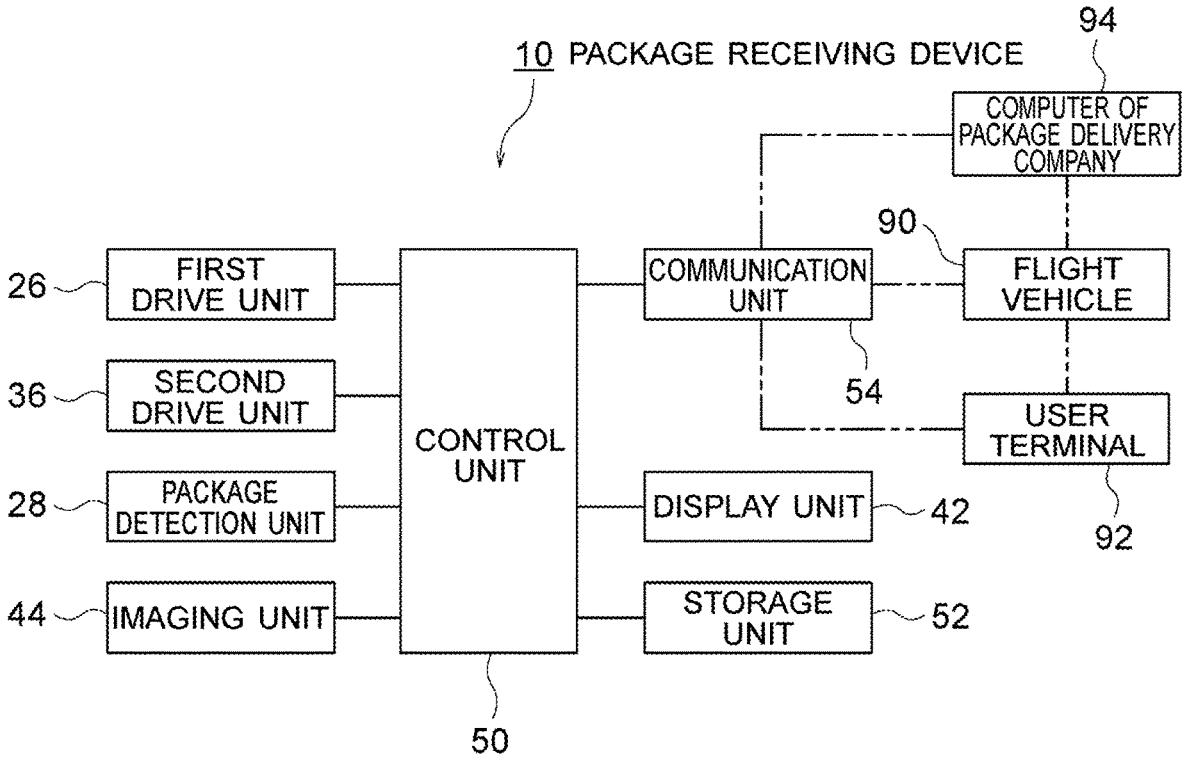
FIG. 7 is a configuration diagram illustrating the configuration of a control system of the package receiving device shown in FIG. 1, etc.
Figure 8:
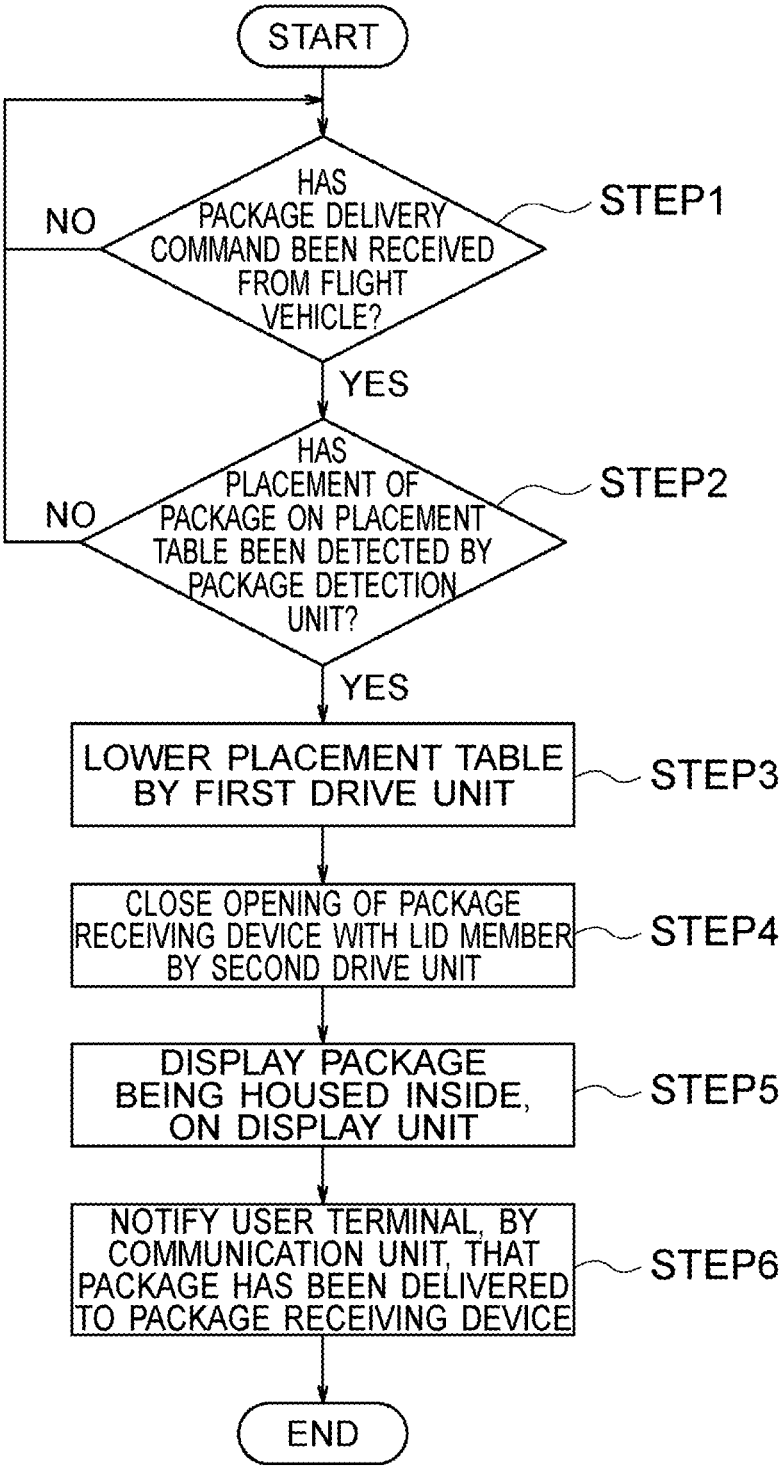
FIG. 8 is a flowchart showing operation when a package is delivered to the package receiving device shown in FIG. 1, etc.
Figure 9:
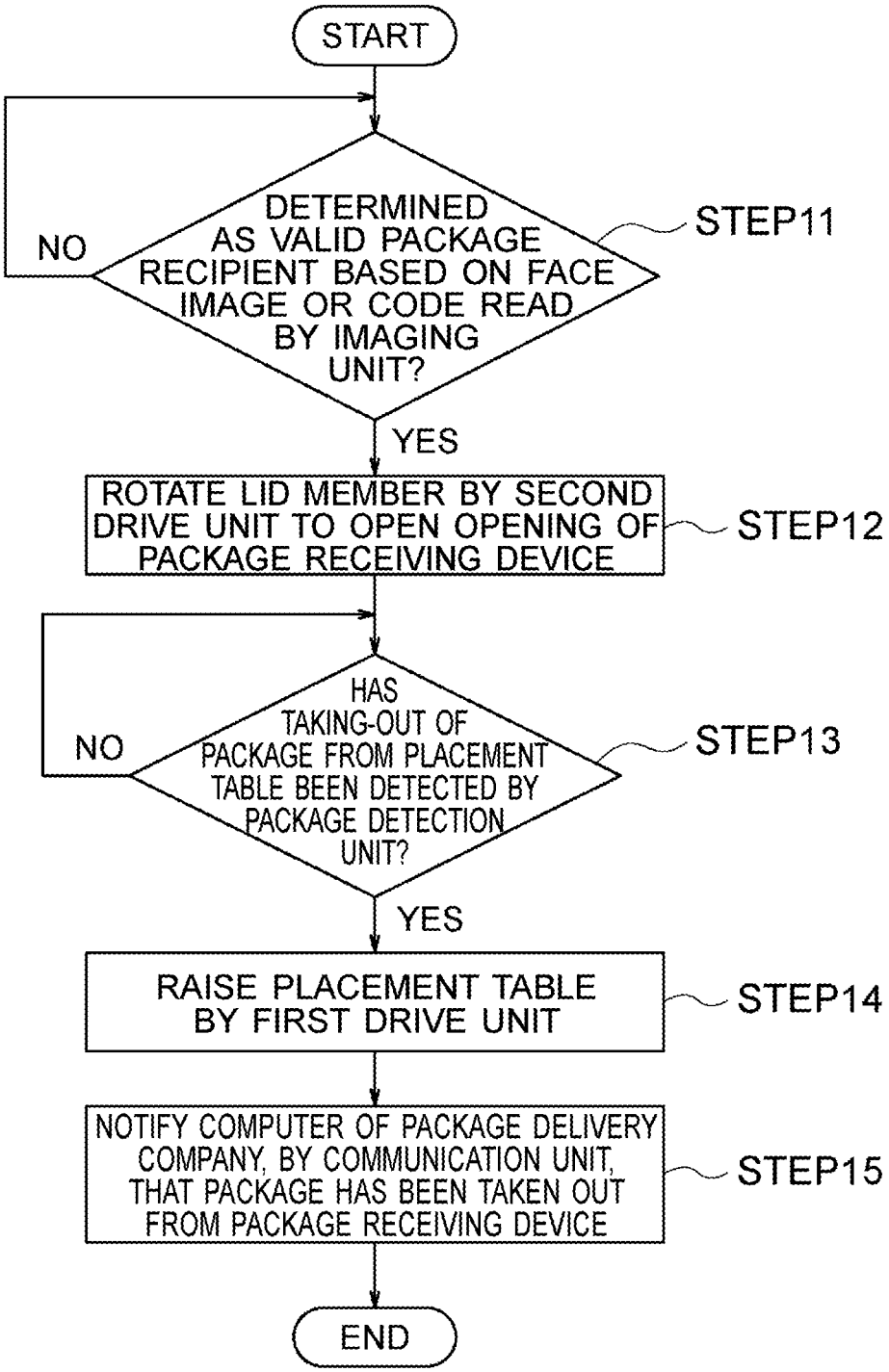
FIG. 9 is a flowchart showing operation when the package is taken out from the package receiving device shown in FIG. 1, etc.

9 illustrate a package receiving device according to the present embodiment. Among them, FIG. 1 to FIG. 3 are each a perspective view schematically illustrating the appearance of the package receiving device according to the present embodiment, and FIG. 4 to FIG. 6 are each a configuration diagram illustrating the internal configuration of the package receiving device shown in FIG. 1, etc. In addition, FIG. 7 is a configuration diagram showing the configuration of a control system of the package receiving device shown in FIG. 1, etc. Moreover, FIG. 8 and FIG. 9 are flowcharts showing operation when a package is delivered to the package receiving device shown in FIG. 1, etc., and when the package is taken out from the package receiving device, respectively. In FIG. 1 to FIG. 9, etc., the package delivered to the package receiving device is denoted by reference character W.

The package receiving device 10 according to the present embodiment receives a package from a flight vehicle 90 such as a drone and houses the received package thereinside. In addition, the package housed inside the package receiving device 10 can be taken out only by a specific user.

First, the flight vehicle 90 such as a drone which delivers a package will be briefly described. The flight vehicle 90 delivers a package from a warehouse or the like of a package delivery company to the package receiving device 10 while suspending the package. In addition, the flight vehicle 90 is provided with a communication unit and a GPS for detecting the current position of the flight vehicle 90, and information about the current position of the flight vehicle 90 detected by the GPS is wirelessly transmitted by the communication unit to a computer 94 (see FIG. 7) of the package delivery company. Moreover, the flight vehicle 90 is provided with an imaging unit such as a camera and can take an image of an area around the flight vehicle 90 (particularly, an area below the flight vehicle 90) by the imaging unit. Image data taken by the imaging unit is also wirelessly transmitted by the communication unit to the computer 94 of the package delivery company.

Next, the configuration of the package receiving device 10 which receives a package delivered by such a flight vehicle 90 will be described with reference to FIG. 1 to FIG. 7. As shown in FIG. 1 to FIG. 6, particularly, in FIG. 1 and FIG. 4, the package receiving device 10 according to the present embodiment includes: a casing 12 that has an opening 12*a* formed in an upper surface thereof and that has a substantially rectangular parallelepiped shape; a placement table 22 that is provided at the upper surface opening 12*a* of the casing 12; a first drive unit 26 that raises and lowers the placement table 22; a lid member 32 for closing the upper surface opening 12*a* of the casing 12; and a second drive unit 36 that rotates the lid member 32 about a shaft 34. A package sent from the flight vehicle 90 to the package receiving device 10 is placed on the placement table 22 of the package receiving device 10. Each component of such a package receiving device 10 will be described in detail below.

The placement table 22 is composed of a flat-plate-shaped stage. The placement table 22 is raised and lowered between a raised position shown in FIG. 4 and a lowered position shown in FIG. 5. Specifically, guide rails 24 for guiding the placement table 22 are disposed on an inner wall of the casing 12 and extend along the height direction of the casing 12. In addition, as shown in FIG. 7, the package receiving device 10 includes the first drive unit 26 such as an actuator which raises and lowers the placement table 22 along the guide rails 24. The placement table 22 is moved between the raised position shown in FIG. 4 and the lowered position shown in FIG. 5 by the first drive unit 26. When the placement table 22 is located at the raised position shown in FIG. 4, the height level of the placement table 22 is substantially equal to the height level of the upper surface opening 12*a* of the casing 12. Moreover, when the placement table 22 is located at the lowered position shown in FIG. 5, the height level of the placement table 22 is a height level that is substantially half the height of the casing 12. Accordingly, after a package is placed on the placement table 22 located at the raised position, when the placement table 22 is lowered from the raised position to the lowered position, the placement table 22 and the package placed on the placement table 22 are housed inside the casing 12.

As shown in FIG. 1, a code 22*a* such as a bar code or a two-dimensional code (for example, a QR code (registered trademark)) is provided on the upper surface of the placement table 22. The code 22*a* indicates identification information of the package receiving device 10 and information about the owner of the package receiving device 10. When such a code 22*a* is read by the imaging unit such as a camera provided in the flight vehicle 90 such as a drone, the identification information of the package receiving device 10 and the information about the owner of the package receiving device 10 are acquired by the flight vehicle 90. The code 22*a* is not limited to a code indicating both the identification information of the package receiving device 10 and the information about the owner of the package receiving device 10. The code 22*a* may indicate either information of the identification information of the package receiving device 10 and the information about the owner of the package receiving device 10.

As shown in FIG. 4, etc., a package detection unit 28 such as a weight meter for detecting placement of a package on the placement table 22 when the package is placed on the placement table 22 is provided on the placement table 22. The package detection unit 28 is not limited to a weight meter that detects the weight of a package placed on the placement table 22. An optical sensor, a camera, or the like that detects a package placed on the placement table 22 may be used as the package detection unit 28.

The lid member 32 is used to close the upper surface opening 12*a* of the casing 12. More specifically, the lid member 32 is composed of a plate-shaped member having substantially the same size as the upper surface opening 12*a* of the casing 12. Such a lid member 32 rotates between an opening position shown in FIG. 4 and a closing position shown in FIG. 6 about the shaft 34 provided at an edge portion of the upper surface opening 12*a* of the casing 12. In addition, as shown in FIG. 7, the package receiving device 10 includes the second drive unit 36 such as a motor which rotates the lid member 32 about the shaft 34. The lid member 32 is rotated between the opening position shown in FIG. 4 and the closing position shown in FIG. 6 by the second drive unit 36. When the lid member 32 is located at the opening position shown in FIG. 4, the lid member 32 is in contact with a side surface of an outer wall of the casing 12. In this case, the upper surface opening 12*a* of the casing 12 is opened. On the other hand, when the lid member 32 is located at the closing position shown in FIG. 6, the upper surface opening 12*a* of the casing 12 is closed by the lid member 32. In this case, when the placement table 22 on which a package has been placed is located at the lowered position, the placement table 22 and the package placed on the placement table 22 cannot be accessed from the outside of the casing 12.

As shown in FIG. 1, etc., a button 40, a display unit 42 such as a monitor, and an imaging unit 44 such as a camera are provided on a front surface of the casing 12. In a state where the lid member 32 is located at the closing position and the upper surface opening 12*a* of the casing 12 is closed by the lid member 32, when the button 40 is pressed by a user, if it is determined by a control unit 50 that this user is a valid package recipient, the lid member 32 rotates about the shaft 34 from the closing position to the opening position, so that the upper surface opening 12*a* of the casing 12 is opened. In addition, in a state where a package has been delivered from the flight vehicle 90 such as a drone to the package receiving device 10 and housed inside the package receiving device 10, information that the package has been housed inside the package receiving device 10 is displayed on the display unit 42. At that time, a message that prompts the user to take out the package from the package receiving device 10 may be displayed on the display unit 42. In addition, information about the date and time at which the package was housed inside the package receiving device 10, information about the type of the package housed inside the package receiving device 10, etc., may be displayed on the display unit 42. Moreover, the imaging unit 44 acquires information about a face image of the user by taking an image of the face of the user.

Next, the configuration of the control system of the package receiving device 10 will be described with reference to FIG. 7. As shown in FIG. 7, the package receiving device 10 includes the control unit 50 for controlling each component of the package receiving device 10, and the control unit 50 is composed of a processor such as a CPU. Specifically, the first drive unit 26, the second drive unit 36, the package detection unit 28, the imaging unit 44, the display unit 42, etc., are connected to the control unit 50. When placement of a package on the placement table 22 is detected by the package detection unit 28, information that the package has been placed on the placement table 22 is sent from the package detection unit 28 to the control unit 50. In addition, information about a face image or the like of the user taken by the imaging unit 44 is sent from the imaging unit 44 to the control unit 50. Moreover, the control unit 50 controls the first drive unit 26 and the second drive unit 36 by sending command signals to the first drive unit 26 and the second drive unit 36. Furthermore, the control unit 50 controls a content to be displayed on the display unit 42, by sending display information to the display unit 42.

As shown in FIG. 7, a storage unit 52 such as a memory is connected to the control unit 50. The storage unit 52 stores therein information about a face image of the user who owns the package receiving device 10. Such a face image of the user can be registered by the user, for example, when the package receiving device 10 is installed. In addition, information such as history of packages housed inside the package receiving device 10 is stored in the storage unit 52. Moreover, a communication unit 54 is connected to the control unit 50. The control unit 50 can transmit and receive signals to and from the flight vehicle 90 such as a drone, a user terminal 92 such as a smartphone carried by the user, and an external device such as the computer 94 of the package delivery company, via the communication unit 54.

Next, the user terminal 92 (for example, a smartphone or the like) of the user who owns the package receiving device 10 will be briefly described. When a package is delivered to the package receiving device 10 by the flight vehicle 90 such as a drone and housed inside the package receiving device 10, information that the package has been housed inside the package receiving device 10 is transmitted from the control unit 50 of the package receiving device 10 to the user terminal 92 by the communication unit 54. Accordingly, the user terminal 92 is notified of the information that the package has been housed inside the package receiving device 10, and the user is notified of this information through screen display or sound by the user terminal 92. In this manner, the user can recognize that the package has been housed inside the package receiving device 10. In addition, during delivery of a package by the flight vehicle 90 such as a drone from the warehouse or the like of the package delivery company to the package receiving device 10, information about the current position of the flight vehicle 90 detected by the GPS, which is provided in the flight vehicle 90, may be transmitted to the user terminal 92 by the communication unit of the flight vehicle 90 or transmitted from the computer 94 of the package delivery company to the user terminal 92. In this case, the user can know where the package is currently located. In addition, code information such as a bar code or a two-dimensional code about key information for opening the lid member 32 of the package receiving device 10 may be transmitted from the computer 94 of the package delivery company or the package receiving device 10 to the user terminal 92. In this case, the code such as a bar code or a two-dimensional code is displayed on the user terminal 92 and the imaging unit 44 such as a camera, which is provided in the package receiving device 10, is caused to read the code, thereby allowing the control unit 50 to determine whether the user is a valid package recipient. Such use of the user terminal 92 will be described in detail later.

Next, operation when a package is delivered to such a package receiving device 10 and operation when the package is taken out from the package receiving device 10 will be described with reference to flowcharts shown in FIG. 8 and FIG. 9. The following operation is performed by the control unit 50 of the package receiving device 10 controlling each component of the package receiving device 10.

First, the operation when the package is delivered to the package receiving device 10 will be described with reference to the flowchart shown in FIG. 8. In an initial state of the package receiving device 10, as shown in FIG. 1 and FIG. 4, the placement table 22 is located at the raised position, and the lid member 32 is located at the opening position. When a package is taken out from the warehouse or the like of the package delivery company by the flight vehicle 90 such as a drone, information that the package has been taken out from the warehouse or the like of the package delivery company is transmitted from the computer 94 of the package delivery company or the flight vehicle 90 to the user terminal 92. Accordingly, the user can recognize that delivery of the package has been started.

Then, when the flight vehicle 90 delivering the package has come close to the package receiving device 10, the code 22*a* such as a bar code or a two-dimensional code, which is provided on the placement table 22 of the package receiving device 10, is read by the imaging unit such as a camera provided in the flight vehicle 90. Accordingly, the identification information of the package receiving device 10 and the information about the owner of the package receiving device 10 are acquired by the flight vehicle 90. Then, when the package receiving device 10 having the code 22*a* an image of which has been taken by the flight vehicle 90 is a package receiving device 10 to which the package is to be delivered, the flight vehicle 90 wirelessly transmits information about a package delivery command to the package receiving device 10 by the communication unit. Accordingly, the control unit 50 of the package receiving device 10 receives the package delivery command from the flight vehicle 90 such as a drone via the communication unit 54 ("YES" in STEP 1). Then, the flight vehicle 90 places the package suspended by the flight vehicle 90, on the placement table 22 of the package receiving device 10. At that time, the placement of the package on the placement table 22 is detected by the package detection unit 28 such as a weight meter or an optical sensor ("YES" in STEP 2).

When the control unit 50 of the package receiving device 10 has received the package delivery command from the flight vehicle 90 such as a drone and the placement of the package on the placement table 22 has been detected by the package detection unit 28, the placement table 22 is lowered from the raised position shown in FIG. 4 to the lowered position shown in FIG. 5 by the first drive unit 26 (STEP 3). Accordingly, as shown in FIG. 2 and FIG. 5, the placement table 22 and the package placed on the placement table 22 are housed inside the casing 12. Then, after the placement table 22 is lowered to the lowered position shown in FIG. 5, the lid member 32 is rotated from the opening position shown in FIG. 5 to the closing position shown in FIG. 6 by the second drive unit 36. Accordingly, the upper surface opening 12*a* of the casing 12 is closed by the lid member 32 (STEP 4). In this case, the placement table 22 and the package placed on the placement table 22 cannot be accessed from the outside of the casing 12.

When the upper surface opening 12*a* of the casing 12 has been closed by the lid member 32, information that the package is being housed inside the package receiving device 10 is displayed on the display unit 42 of the package receiving device 10 (STEP 5). Accordingly, the user who has seen the display unit 42 can recognize that the package has been housed inside the package receiving device 10. In addition, the control unit 50 transmits information that the package has been delivered to the package receiving device 10, to the user terminal 92 by the communication unit 54 (STEP 6). Accordingly, the information that the package has been delivered to the package receiving device 10 is displayed on the user terminal 92, so that the user can recognize that the package has been delivered to the package receiving device 10, even when the user is distant from the package receiving device 10. The control unit 50 also transmits the information that the package has been delivered to the package receiving device 10, to the computer 94 of the package delivery company by the communication unit 54. Thereafter, the flight vehicle 90 such as a drone returns from the package receiving device 10 to the warehouse or the like of the package delivery company.

Next, the operation when the package is taken out from the package receiving device 10 shown in FIG. 1, etc., will be described with reference to the flowchart shown in FIG. 9. The user who is about to take out the package from the package receiving device 10 initially comes close to the package receiving device 10 to cause the imaging unit 44 such as a camera, which is provided in the package receiving device 10, to take a face image. Since the information about the face image of the user who owns the package receiving device 10 is registered in the storage unit 52 of the package receiving device 10 as described above, the control unit 50 can determine whether the user is a valid package recipient, on the basis of the face image taken by the imaging unit 44 (STEP 11). That is, if the face image taken by the imaging unit 44 substantially matches the face image of the user stored in the storage unit 52, the control unit 50 determines that the user is the valid package recipient.

Then, the user who is about to take out the package from the package receiving device 10 presses the button 40 which is provided on the front surface of the casing 12. When the button 40 is pressed, if the control unit 50 has determined that the user is the valid package recipient ("YES" in STEP 11), the lid member 32 is rotated from the closing position shown in FIG. 6 to the opening position shown in FIG. 5 by the second drive unit 36. Accordingly, the upper surface opening 12*a* of the casing 12 is opened (STEP 12). As a result, the user can access the package placed on the placement table 22 from the outside of the casing 12 and take out the package. Even if the user does not press the button 40, when a face image of the user is taken by the imaging unit 44, if the control unit 50 determines that the user is the valid package recipient on the basis of the face image, the lid member 32 may be automatically rotated from the closing position shown in FIG. 6 to the opening position shown in FIG. 5.

When the package has been taken out from the inside of the package receiving device 10 by the user, the taking-out of the package from the placement table 22 is detected by the package detection unit 28 such as a weight meter or an optical sensor ("YES" in STEP 13). Then, when the taking-out of the package from the placement table 22 has been detected by the package detection unit 28, the placement table 22 is raised from the lowered position shown in FIG. 5 to the raised position shown in FIG. 4 by the first drive unit 26 (STEP 14). Accordingly, the package receiving device 10 returns to the initial state shown in FIG. 1 and FIG. 4. In addition, the control unit 50 transmits information that the package has been taken out from the package receiving device 10, to the computer 94 of the package delivery company by the communication unit 54 (STEP 15). Accordingly, the computer 94 of the package delivery company determines that the task of package delivery has been completed.

The method by which the control unit 50 determines whether the user who has come close to the package receiving device 10 is the valid package recipient is not limited to the above method. Another method will be described below. First, when a user requests the package delivery company to deliver a package, an e-mail address or the like of a package recipient is registered. In addition, the computer 94 of the package delivery company issues key information for opening the lid member 32 of the package receiving device 10. Then, when the package is delivered to the package receiving device 10 by the flight vehicle 90 such as a drone, a code information such as a bar code or a two-dimensional code about the key information issued by the computer 94 is transmitted from the flight vehicle 90 or the computer 94 of the package delivery company to the registered e-mail address of the package recipient. In this case, a user who is about to take out the package from the package receiving device 10 comes close to the package receiving device 10 and also causes the user terminal 92 to display the code and causes the imaging unit 44 such as a camera, which is provided in the package receiving device 10, to take an image of the code. Then, if the key information based on the code read by the imaging unit 44 substantially matches the key information issued by the computer, the control unit 50 determines that the user is the valid package recipient. In such an aspect, when a user requests the package delivery company to deliver a package, the user registers an e-mail address or the like of a user other than the owner of the package receiving device 10 as an e-mail address or the like of a package recipient, thereby allowing even the user other than the owner of the package receiving device 10 to take out the package from the package receiving device 10.

In the package receiving device 10 and the package receiving method according to the present embodiment having the above configuration, in the initial state where the placement table 22 is located at the raised position and the lid member 32 is located at the opening position, when a package delivered by the flight vehicle 90 such as a drone is placed on the placement table 22, the placement table 22 is moved from the raised position to the lowered position, and the lid member 32 is subsequently moved from the opening position to the closing position. Accordingly, the package delivered by the flight vehicle 90 can be received and housed inside the casing 12. More specifically, in the case where the placement table 22 cannot be raised and lowered between the raised position and the lowered position and is merely provided and fixed inside the casing 12, when a package delivered by the flight vehicle 90 is placed on the placement table located inside the casing 12, a propeller or the like of the flight vehicle 90 may come into contact with the upper edge of the casing 12, so that the flight vehicle 90 may lose balance or be damaged. In contrast, in the present embodiment, when the placement table 22 is located at the upper surface position at which the upper surface opening 12*a* of the casing 12 is located, a package is placed on the placement table 22 from the flight vehicle 90, and thus a propeller or the like of the flight vehicle 90 can be prevented from coming into contact with the casing 12. In addition, after the placement table 22 on which the package has been placed is moved from the raised position to the lowered position, the lid member 32 is moved from the opening position to the closing position, whereby the package can be prevented from being accessed from the outside of the casing 12, so that anti-theft performance can be improved. Moreover, since the upper surface opening 12*a* of the casing 12 is closed by the lid member 32, the package housed inside the casing 12 can be prevented from getting wet with rain.

In the package receiving device 10 and the package receiving method according to the present embodiment, as described above, in the initial state where the placement table 22 is located at the raised position and the lid member 32 is located at the opening position, when placement of a package on the placement table 22 is detected by the package detection unit 28 and a package delivery command is received from an external device (specifically, the computer 94 of the package delivery company or the flight vehicle 90) via the communication unit 54, the placement table 22 is moved from the raised position to the lowered position, and the lid member 32 is subsequently moved from the opening position to the closing position. In this case, only the package delivered to the package receiving device 10 by the flight vehicle 90 can be reliably housed inside the casing 12. More specifically, for example, even when a small animal such as a cat or a squirrel gets on the placement table 22 or an object is placed on the placement table 22 by mischief and the placement of the small animal or the object on the placement table 22 is detected by the package detection unit 28, the placement table 22 does not move from the raised position to the lowered position only for that reason. Thus, a small animal or an object other than a package delivered by the flight vehicle 90 can be prevented from being accidentally housed inside the casing 12. Moreover, an error signal, on the basis of which the placement table 22 is moved from the raised position to the lowered position, can be prevented from being transmitted from the flight vehicle 90 to the communication unit 54 of the package receiving device 10 even when a package has not been placed on the placement table 22.

The present embodiment is not limited to such an aspect. In another aspect, in the initial state where the placement table 22 is located at the raised position and the lid member 32 is located at the opening position, when placement of a package on the placement table 22 is detected by the package detection unit 28, the placement table 22 may be moved from the raised position to the lowered position, and the lid member 32 may be subsequently moved from the opening position to the closing position. In the case where a small animal does not get on the placement table 22 or an object is not placed on the placement table 22 by mischief, for example, in the case where the package receiving device 10 is surrounded by a fence or the like, even if a package delivery command is not received from an external device (specifically, the computer 94 of the package delivery company or the flight vehicle 90) via the communication unit 54, only when placement of a package on the placement table 22 is detected by the package detection unit 28, the placement table 22 may be moved from the raised position to the lowered position.

In still another aspect, in the initial state where the placement table 22 is located at the raised position and the lid member 32 is located at the opening position, when a package delivery command is received from an external device (specifically, the computer 94 of the package delivery company or the flight vehicle 90) via the communication unit 54, the placement table 22 may be moved from the raised position to the lowered position, and the lid member 32 may be subsequently moved from the opening position to the closing position. In this case, installation of the package detection unit 28 such as a weight meter or an optical sensor can be omitted.

After a package delivered by the flight vehicle 90 is placed on the placement table 22 of the package receiving device 10, the placement table 22 may be moved from the raised position to the lowered position by the user sending a command with the user terminal 92 such as a smartphone.

In the package receiving device 10 according to the present embodiment, as described above, the lid member 32 rotates between the opening position and the closing position about the shaft 34 provided at the edge portion of the upper surface opening 12*a* of the casing 12. In this case, when the lid member 32 is located at the opening position, the lid member 32 is in contact with the side surface of the outer wall of the casing 12. Thus, the lid member 32 does not become an obstacle in the initial state of the package receiving device 10, and the entire configuration of the package receiving device 10 can be compact.

In the package receiving device 10 according to the present embodiment, as described above, the code 22*a* indicating at least either information of the identification information of the package receiving device 10 and the information about the owner of the package receiving device 10 is provided on the surface of the placement table 22 such that the code 22*a* is readable by the imaging unit of the flight vehicle 90. In this case, the flight vehicle 90 can more reliably identify a package receiving device 10 to which a package is to be delivered, and thus can accurately place a package delivered by the flight vehicle 90, on the placement table 22 of a predetermined package receiving device 10.

In the package receiving device 10 according to the present embodiment, as described above, when the control unit 50 has determined that a user who is about to take out a package housed inside the casing 12 is a valid package recipient, the control unit 50 controls the second drive unit 36 to move the lid member 32 from the closing position to the opening position. In this case, the package can be prevented from being taken away from the inside of the casing 12 by a third party after the package is housed inside the casing 12.

Here, the package receiving device 10 according to the present embodiment further includes the imaging unit 44 and the storage unit 52, and a face image of a certain user is stored in the storage unit 52. When a face image of a user taken by the imaging unit 44 substantially matches the face image of the certain user stored in the storage unit 52, the control unit 50 determines that the user who is about to take out a package housed inside the casing 12 is a valid package recipient. In this case, only the user registered in advance in the storage unit 52 of the package receiving device 10 (specifically, for example, the owner of the package receiving device 10) can take out the package housed inside the casing 12, and thus the anti-theft performance of the package receiving device 10 can be improved.

In another method, the package receiving device 10 according to the present embodiment may further include: a communication unit 54 that receives at least a signal from an external device; and an input means for inputting key information for opening the lid member 32, and, when key information, for opening the lid member 32, that is inputted by the input means substantially matches key information, for opening the lid member 32, that is received from an external device by the communication unit 54, the control unit 50 may determine that a user who is about to take out a package housed inside the casing 12 is a valid package recipient. Here, the input means is, for example, an imaging unit 44, and the imaging unit 44 takes an image of a code about key information displayed on the user terminal 92 carried by the user, whereby the key information is inputted to the control unit 50. The input means is not limited to the imaging unit 44. Input buttons, a touch panel, or the like used by an operator to input key information (specifically, for example, several or dozens of digits or roman letters) may be provided on the front surface of the casing 12, and the user may input key information by using the input buttons, the touch panel, or the like.

The package receiving device and the package receiving method according to the present invention are not limited to the above-described aspects, and various modifications can be made.

For example, the package receiving device 10 shown in FIG. 1, etc., may be provided with a beacon (a transmitter that transmits a radio signal within a range having a radius of several tens of meters). When delivery of a package by the flight vehicle 90 such as a drone has been started, the control unit 50 of a package receiving device 10 to which the package is to be delivered receives information about a package delivery command from the computer 94 of the package delivery company or the flight vehicle 90. When the control unit 50 of the package receiving device 10 has received the information about the package delivery command, the control unit 50 transmits a radio signal within a range having a radius of several tens of meters by the beacon. Meanwhile, the package receiving device 10 and the flight vehicle 90 such as a drone are each provided with a GPS. The flight vehicle 90 such as a drone that is delivering the package grasps the current position of the flight vehicle 90 by the GPS provided in the flight vehicle 90, and also grasps the position of the package receiving device 10 that is the delivery destination of the package, by the GPS provided in the package receiving device 10. Then, the flight vehicle 90 comes close to the package receiving device 10 to which the package is to be delivered, on the basis of the current position of the flight vehicle 90 and the position of the package receiving device 10 grasped by the GPSs. The flight vehicle 90 that has come close to the package receiving device 10 can know the accurate position of the package receiving device 10 by receiving the radio signal transmitted from the beacon. Then, the flight vehicle 90 places the package suspended by the flight vehicle 90, on the placement table 22 of the package receiving device 10 on the basis of the radio signal transmitted from the beacon. With such a method, the flight vehicle 90 can more accurately deliver the package to the placement table 22 of the package receiving device 10.

Figure 10:
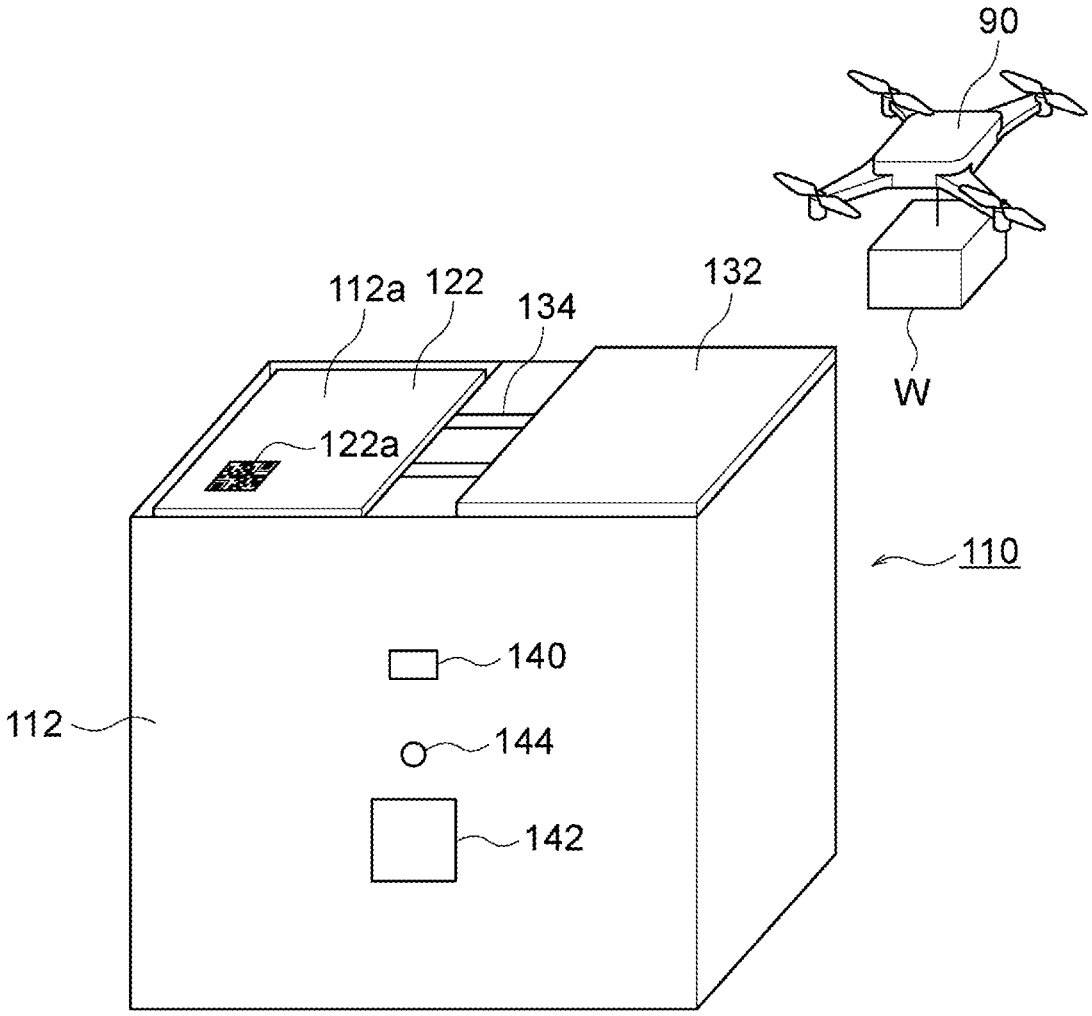
FIG. 10 is a perspective view schematically illustrating the appearance of a package receiving device according to another example of the embodiment of the present invention.
Figure 11:
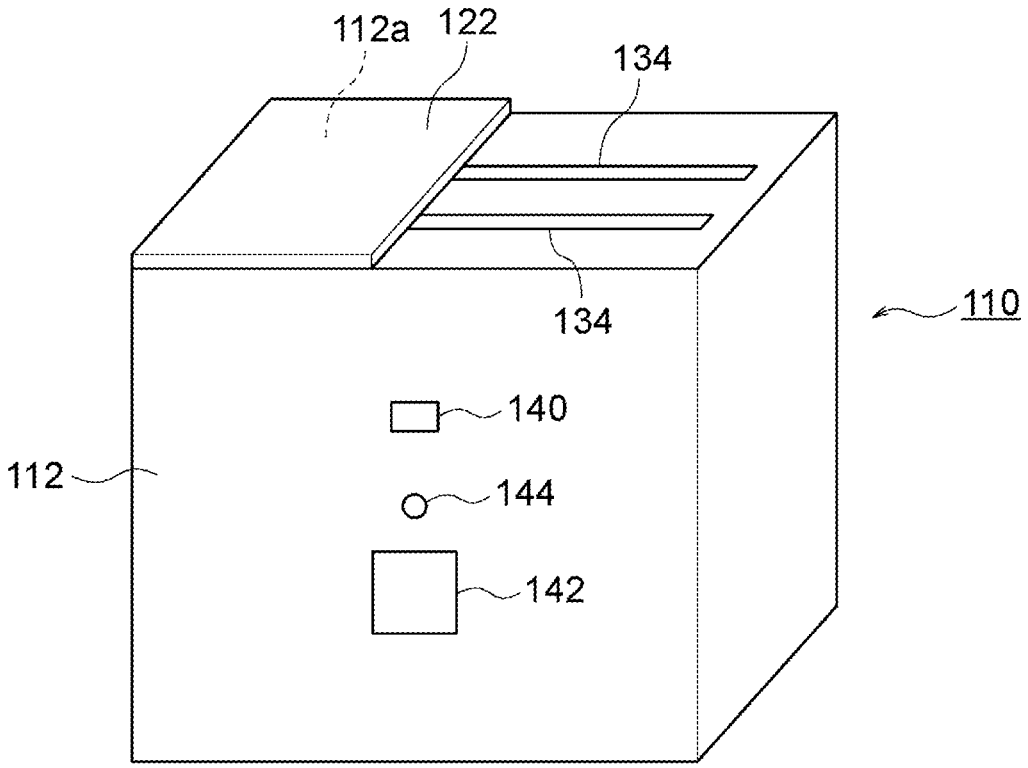
FIG. 11 is a perspective view illustrating a state when a placement table of the package receiving device shown in FIG. 10 is lowered and an upper opening is closed by a lid member after a package is placed on the placement table.

A device configured as shown in FIG. 10 and FIG. 11 may be used as a package receiving device. FIG. 10 and FIG. 11 are perspective views schematically illustrating the appearance of a package receiving device 110 according to a modification of the present embodiment.

The package receiving device 110 according to the modification includes: a casing 112 that has an opening 112*a* formed in an upper surface thereof and that has a substantially rectangular parallelepiped shape; a placement table 122 that is provided at the upper surface opening 112*a* of the casing 112; a first drive unit (not shown) that raises and lowers the placement table 122; a lid member 132 for closing the upper surface opening 112*a* of the casing 112; and a second drive unit (not shown) that slides the lid member 132 along guide rails 134. A package sent from the flight vehicle 90 to the package receiving device 110 is placed on the placement table 122 of the package receiving device 110. In the package receiving device 110 shown in FIG. 10, etc., unlike the package receiving device 10 shown in FIG. 1, etc., the opening 112*a* is not formed in the entirety of the upper surface of the casing 112 but formed only in a part of the upper surface of the casing 112. Each component of such a package receiving device 110 will be described below.

The placement table 122 is composed of a flat-plate-shaped stage. The placement table 122 is raised and lowered between a raised position and a lowered position. Specifically, guide rails (not shown) for guiding the placement table 122 are disposed on an inner wall of the casing 112 and extend along the height direction of the casing 112. In addition, the package receiving device 110 includes the first drive unit such as an actuator which raises and lowers the placement table 122 along the guide rails. The placement table 122 is moved between the raised position and the lowered position by the first drive unit. When the placement table 122 is located at the raised position shown in FIG. 10, the height level of the placement table 122 is substantially equal to the height level of the upper surface opening 112*a* of the casing 112. Moreover, when the placement table 122 is located at the lowered position, the height level of the placement table 122 is a height level that is substantially half the height of the casing 112. Accordingly, after a package is placed on the placement table 122 located at the raised position, when the placement table 122 is lowered from the raised position to the lowered position, the placement table 122 and the package placed on the placement table 122 are housed inside the casing 112.

As shown in FIG. 10, a code 122*a* such as a bar code or a two-dimensional code (for example, a QR code (registered trademark)) is provided on the upper surface of the placement table 122. The code 122*a* indicates identification information of the package receiving device 110 and information about the owner of the package receiving device 110. When such a code 122*a* is read by the imaging unit such as a camera provided in the flight vehicle 90 such as a drone, the identification information of the package receiving device 110 and the information about the owner of the package receiving device 110 are acquired by the flight vehicle 90. Moreover, a package detection unit (not shown)

such as a weight meter or an optical sensor for detecting placement of a package on the placement table 122 when the package is placed on the placement table 122 is provided on the placement table 122.

The lid member 132 is used to close the upper surface opening 112*a* of the casing 112. More specifically, the lid member 132 is composed of a plate-shaped member having substantially the same size as the upper surface opening 112*a* of the casing 112. Such a lid member 132 slides along the guide rails 134 between an opening position shown in FIG. 10 and a closing position shown in FIG. 11. In addition, the package receiving device 110 includes the second drive unit such as an actuator which slides the lid member 132 along the guide rails 134. The lid member 132 is moved between the opening position shown in FIG. 10 and the closing position shown in FIG. 11 by the second drive unit. When the lid member 132 is located at the closing position shown in FIG. 11, the upper surface opening 112*a* of the casing 112 is closed by the lid member 132. In this case, when the placement table 122 on which a package has been placed is located at the lowered position, the placement table 122 and the package placed on the placement table 122 cannot be accessed from the outside of the casing 112.

As shown in FIG. 10, etc., a button 140, a display unit 142 such as a monitor, and an imaging unit 144 such as a camera are provided on a front surface of the casing 112. The button 140, the display unit 142, and the imaging unit 144 have substantially the same configurations and functions as the button 40, the display unit 42, and the imaging unit 44 shown in FIG. 1, etc., respectively, and thus the description thereof is omitted.

Similar to the package receiving device 10 shown in FIG. 1, etc., the package receiving device 110 shown in FIG. 10, etc., also includes a control unit (not shown) for controlling each component of the package receiving device 110, and the control unit is composed of a processor such as a CPU. The control unit of the package receiving device 110 has substantially the same configuration and function as the control unit 50 of the package receiving device 10, and thus the description thereof is omitted.

In the package receiving device 110 shown in FIG. 10, etc., and a package receiving method by such a package receiving device 110, in an initial state where the placement table 122 is located at the raised position and the lid member 132 is located at the opening position (specifically, the state shown in FIG. 10), when a package delivered by the flight vehicle 90 such as a drone is placed on the placement table 122, the placement table 122 is moved from the raised position to the lowered position, and the lid member 132 is subsequently slid from the opening position shown in FIG. 10 to the closing position shown in FIG. 11. Accordingly, the package delivered by the flight vehicle 90 can be received and housed inside the casing 112. More specifically, in the case where the placement table 122 cannot be raised and lowered between the raised position and the lowered position and is merely provided and fixed inside the casing 112, when a package delivered by the flight vehicle 90 is placed on the placement table located inside the casing 112, a propeller or the like of the flight vehicle 90 may come into contact with the upper edge of the casing 112, so that the flight vehicle 90 may lose balance or be damaged. In contrast, in the package receiving device 110 shown in FIG. 10, etc., when the placement table 122 is located at the upper surface position at which the upper surface opening 112*a* of the casing 112 is located, a package is placed on the placement table 22 from the flight vehicle 90, and thus a propeller or the like of the flight vehicle 90 can be prevented from coming into contact with the casing 112. In addition, after the placement table 122 on which the package has been placed is moved from the raised position to the lowered position, the lid member 132 is moved from the opening position to the closing position, whereby the package can be prevented from being accessed from the outside of the casing 112, so that anti-theft performance can be improved. Moreover, since the upper surface opening 112*a* of the casing 112 is closed by the lid member 132, the package housed inside the casing 112 can be prevented from getting wet with rain. In the package receiving device 110 shown in FIG. 10, etc., unlike the package receiving device 10 shown in FIG. 1, etc., the lid member 132 is slid along the guide rails 134. Thus, a space for placing the lid member 132 located at the opening position is required, and the size of the package receiving device 110 needs to be increased.

What is claimed is:

1. A package receiving device comprising:

a casing having opposed walls and an opening formed in an upper surface thereof;

guide rails disposed on the opposed walls of the casing;

a placement table configured to move up and down between a raised position at which the placement table is located at the upper surface opening of the casing and a lowered position at which the placement table is located inside the casing;

a first drive unit configured to move the placement table along the guide rails between the raised position and the lowered position;

a lid member configured to move between an opening position at which the lid member opens the upper surface opening of the casing and a closing position at which the lid member closes the upper surface opening of the casing;

a second drive unit configured to move the lid member between the opening position and the closing position;

a control unit configured to control the first drive unit and the second drive unit such that a package placed on the placement table is housed inside the casing, by moving the placement table from the raised position to the lowered position from an initial state where the placement table is located at the raised position and the lid member is located at the opening position, and subsequently moving the lid member from the opening position to the closing position, and a package detection unit configured to detect placement of a package on the placement table when the package is placed on the placement table, wherein when placement of a package on the placement table is detected by the package detection unit in the initial state where the placement table is located at the raised position and the lid member is located at the opening position, the control unit controls the first drive unit and the second drive unit such that the placement table is moved from the raised position to the lowered position and the lid member is subsequently moved from the opening position to the closing position.

2. The package receiving device according to claim 1, further comprising a communication unit configured to receive at least a signal from an external device, wherein when the control unit receives a package delivery command from the external device via the communication unit, the control unit controls the first drive unit and the second drive unit such that the placement table is moved from the raised position to the lowered position and the lid member is subsequently moved from the opening position to the closing position.

3. The package receiving device according to claim 1, further comprising:

a package detection unit configured to detect placement of a package on the placement table when the package is placed on the placement table; and a communication unit configured to receive at least a signal from an external device, wherein when placement of a package on the placement table is detected by the package detection unit in the initial state where the placement table is located at the raised position and the lid member is located at the opening position, and the control unit receives a package delivery command from the external device via the communication unit, the control unit controls the first drive unit and the second drive unit such that the placement table is moved from the raised position to the lowered position and the lid member is subsequently moved from the opening position to the closing position.

4. The package receiving device according to claim 1, wherein the lid member is configured to rotate between the opening position and the closing position about a shaft provided at an edge portion of the upper surface opening of the casing.

5. The package receiving device according to claim 1, wherein a code indicating at least either information of identification information of the package receiving device and information about an owner of the package receiving device is provided on a surface of the placement table such that the code is readable by an imaging unit of a flight vehicle configured to deliver a package.

6. The package receiving device according to claim 1, wherein, when the control unit determines that a user who is about to take out a package housed inside the casing is a valid package recipient, the control unit controls the second drive unit such that the lid member is moved from the closing position to the opening position.

7. The package receiving device according to claim 6, further comprising an imaging unit and a storage unit, wherein a face image of a certain user is stored in the storage unit, and when a face image of a user taken by the imaging unit substantially matches the face image of the certain user stored in the storage unit, the control unit determines that the user who is about to take out a package housed inside the casing is a valid package recipient.

8. The package receiving device according to claim 6, further comprising:

a communication unit configured to receive at least a signal from an external device; and an input means for inputting key information for opening the lid member, wherein when key information, for opening the lid member, that is inputted by the input means substantially matches key information, for opening the lid member, that is received from the external device by the communication unit, the control unit determines that a user who is about to take out a package housed inside the casing is a valid package recipient.

9. A package receiving method using the package receiving device of claim 1, the package receiving method comprising the steps of:

using the first drive unit to move the placement table from the raised position to the lowered position from an initial state where the placement table is located at the raised position and the lid member is located at the opening position; and using the second drive unit to move the lid member from the opening position to the closing position after moving the placement table from the raised position to the lowered position.

10. The package receiving method according to claim 9, wherein, in the initial state where the placement table is located at the raised position and the lid member is located at the opening position, when placement of a package on the placement table is detected by a package detection unit, the placement table is moved from the raised position to the lowered position, and the lid member is subsequently moved from the opening position to the closing position.

11. The package receiving method according to claim 9, wherein, in the initial state where the placement table is located at the raised position and the lid member is located at the opening position, when a package delivery command is received from an external device via a communication unit, the placement table is moved from the raised position to the lowered position, and the lid member is subsequently moved from the opening position to the closing position.

12. The package receiving method according to claim 9, wherein, in the initial state where the placement table is located at the raised position and the lid member is located at the opening position, when placement of a package on the placement table is detected by a package detection unit and a package delivery command is received from an external device via a communication unit, the placement table is moved from the raised position to the lowered position, and the lid member is subsequently moved from the opening position to the closing position.

13. The package receiving device according to claim 1 wherein the package detection device is a weight meter.

* * * * *